US006640347B2

(12) United States Patent
Fukasawa

(10) Patent No.: US 6,640,347 B2
(45) Date of Patent: Nov. 4, 2003

(54) GOGGLES FOR SWIMMING

(75) Inventor: Shunji Fukasawa, Tokyo (JP)

(73) Assignee: Tabata Co. Ltd., Tokyo (JP)

( * ) Notice: Subject to any disclaimer, the term of this patent is extended or adjusted under 35 U.S.C. 154(b) by 0 days.

(21) Appl. No.: 10/227,357

(22) Filed: Aug. 26, 2002

(65) Prior Publication Data

US 2003/0037367 A1 Feb. 27, 2003

(30) Foreign Application Priority Data

Aug. 27, 2001 (JP) ..... 2001-256725

(51) Int. Cl.[7] ..... A61F 9/02
(52) U.S. Cl. ..... 2/428; 2/452
(58) Field of Search ..... 2/426, 439, 440, 2/441, 442, 448, 450, 452, 428, 429, 430, 447, 445; 24/174, 186; 351/43, 44, 158

(56) References Cited

U.S. PATENT DOCUMENTS 5,459,882 A * 10/1995 Yamamoto ..... 2/428
5,596,771 A * 1/1997 Hsu et al. ..... 2/428
5,857,221 A * 1/1999 Geneve et al. ..... 2/428
5,867,841 A * 2/1999 Chiang ..... 2/436
5,956,778 A * 9/1999 Godoy ..... 2/428
6,247,187 B1 * 6/2001 Chiang ..... 2/428
6,317,897 B1 * 11/2001 Chiang ..... 2/428
6,446,272 B1 * 9/2002 Lee ..... 2/428
6,460,196 B2 * 10/2002 Tsubooka et al. ..... 2/428

FOREIGN PATENT DOCUMENTS

JP 7-49969 11/1995

* cited by examiner

*Primary Examiner*—Gary L. Welch
(74) *Attorney, Agent, or Firm*—Clark & Brody

(57) ABSTRACT

A pair of goggles for swimming comprises a pair of frames encircling respective lenses and a head band. Each of the frames is formed on its rear end with upper and lower arms which are formed, in turn, on rear ends thereof with projections opposed to each other. Each of coupling members to couple the head band to the respective frames comprises a locking section adapted to be received between the upper and lower arms from the front of the goggles and, a belt-like section extending rearward from the rear end of the locking section and having a width or thickness smaller than a distance R between the projections and a head band insertion slot formed in the rear end of the belt-like section.

6 Claims, 3 Drawing Sheets

GOGGLES FOR SWIMMING

BACKGROUND OF THE INVENTION

This invention relates to goggles for swimming.

Japanese Utility Model Publication No. 1995-49969A discloses a buckle assembly used in goggles for swimming or the like. This buckle assembly of the prior art comprises a coupling region which is elastically deformable so as to be detachably engaged with a desired region of the goggles' frame and a head band receiving region formed integrally with the coupling region. The head band is length-adjustable in the head band receiving region.

With the buckle assembly disclosed in the above-cited Publication, the length-adjustment of the head band may be easily carried out without obstruction due to the presence of the frame as well as lenses since the buckle assembly can be disassembled from the frame. However, such a buckle assembly should be made of hard plastics, so a certain force is required for a wearer to elastically deform the assembly with his or her fingertips. This requirement has made some of the wearers feel inconvenience to use such a buckle assembly.

SUMMARY OF THE INVENTION

It is an object of this invention to improve goggles for swimming with a head band adapted to be detachably attached to a frame so that no conscious force is required for operation of attaching and detaching the head band to the frame and thereby to facilitate this operation.

According to this invention, there is provided a pair of goggles for swimming comprising a pair of lenses each having front and rear surfaces, a pair of frames encircling the respective lenses and a head band coupled to respective rear ends of the frames.

Each of the frames has upper and lower arms extending rearward from the associated end of the rear ends in parallel to each other, the upper and lower arms having projections opposed to each other on respective rear ends wherein a distance between the projections is smaller than a distance between the upper and lower arms as measured in front of the projections, and the head band is coupled to the frames by means of rubbery elastic coupling members and adapted to be detachably held between the upper and lower ends, each of the coupling members comprising a locking section extending between the upper and lower arms and adapted to come in close contact with the projections from the front, and in contact with a part of the frame near the lenses rather than the projections from the front, a flexible belt-like section extending rearward from the rear end of the locking section and passing between the upper and lower arms, and a slot formed in the rear end of the belt-like section for insertion of the head band wherein at least one of width and thickness of the belt-like section is smaller than a distance between the projections.

This invention can be implemented also in such manners as follow:

(1) The head band is provided behind the coupling members with buckles for length-adjustment of the head band.

(2) Between the upper and lower arms, there is provided a region adapted to come in close contact with the rear surface of the locking section.

(3) The locking section has a side surface opposed to the upper arm and a side surface opposed to the lower arm, at least one of these side surfaces is formed, in the vicinity of the rear surface, with a stopper projection adapted to come in close contact with the upper arm or the lower arm in the direction from the rear surface toward the front surface of the locking section and thereby to prevent the locking section from falling off forward from between the upper and lower arms.

(4) The belt-like section of the coupling member has its thickness dimensioned to be smaller in a longitudinally middle region thereof.

(5) The head band is coupled to the rear end of the belt-like section so as to extend rearward therefrom at an angle of 90° ±15° with respect to the front surface of the lens.

DETAILED DESCRIPTION OF THE PREFERRED EMBODIMENTS

Details of the goggles for swimming according to this invention will be more fully understood from the description given hereunder in reference to the accompanying drawings.

Figure 1:
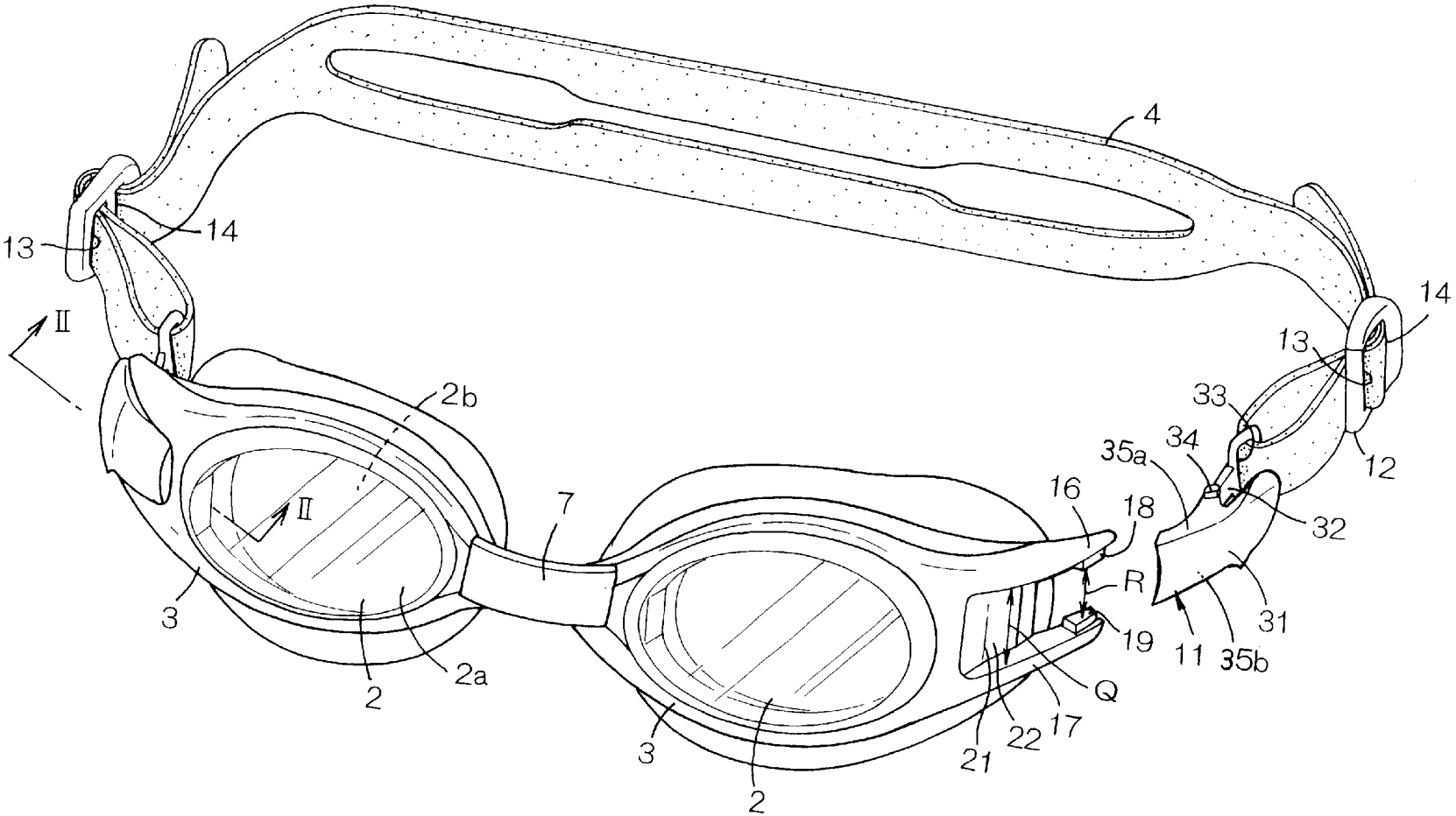
FIG. 1 is a perspective view showing goggles for swimming as partially disassembled.

A pair of goggles shown by FIG. 1 in a perspective view as partially disassembled comprises a pair of lenses 2, a pair of frames 3 formed to encircle the respective lenses 2 and a single head band 4 extending rearward from the respective frames 3 wherein the each of lenses 2 has front and rear surfaces 2*a*, 2*b*. The lenses 2 and the frames 3 are integrally molded from a hard plastic material such as polycarbonate. The frames 3 are provided along peripheries thereof with cushion pads made of a soft elastic material, respectively, and the pair of lenses 2 or frames 3 have respective inner ends connected to each other by means of a nose belt 7. The head band 4 is made of a rubber or a plastic elastomer and has its longitudinal opposite end portions folded back by associated coupling members 11 and tips of these double-layered portions of the band 4 are successively inserted through two rows of apertures 13, 14 extending in parallel to the width of the band 4 of associated buckles 12 whereby the length of the head band 4 may be adjusted. FIG. 1 illustrates one of the coupling members 11 as having been coupled to the associated frame 3 and the other coupling member 11 as having been decoupled from the associated frame 3.

The frames 3 has upper and lower arms 16, 17 extending in parallel to each other rearward with respect to the wearer's head and, in the vicinity of their rear ends, these arms 16, 17 are provided with projections 18, 19 extending from inner sides of the respective arms 16, 17 toward the opposed arms 17, 16, i.e., in a vertical direction as viewed in FIG. 1. A smooth section 21 is defined between the upper and lower arms 16, 17 on the part of the frame 3 near the lens 2. The surface position of this smooth section 21 is lowered than the outer faces of the respective arms 16, 17 so that this smooth section 21 cooperates with the upper and lower arms 16, 17 to define a recess 22 adapted to receive the coupling member 11.

Each of the coupling members 11 attached to opposite ends of the head band 4 is made of a rubbery elastic material such as rubber or plastic elastomer comprising a locking section 31 adapted to be received into the recess 22 of the frame 3, a flexible belt-like section 32 extending rearward from a rear surface 36 of the locking section 31 and a band insertion slot 33 formed in a rear end of the belt-like section 32. The locking section 31 has a pair of opposed side faces 35*a*, 35*b* which face, in turn, the upper and lower arms 16, 17, respectively, and these side faces 35*a*, 35*b* are respectively formed with stopper projections 34 (See FIG. 3 also).

Figure 2:
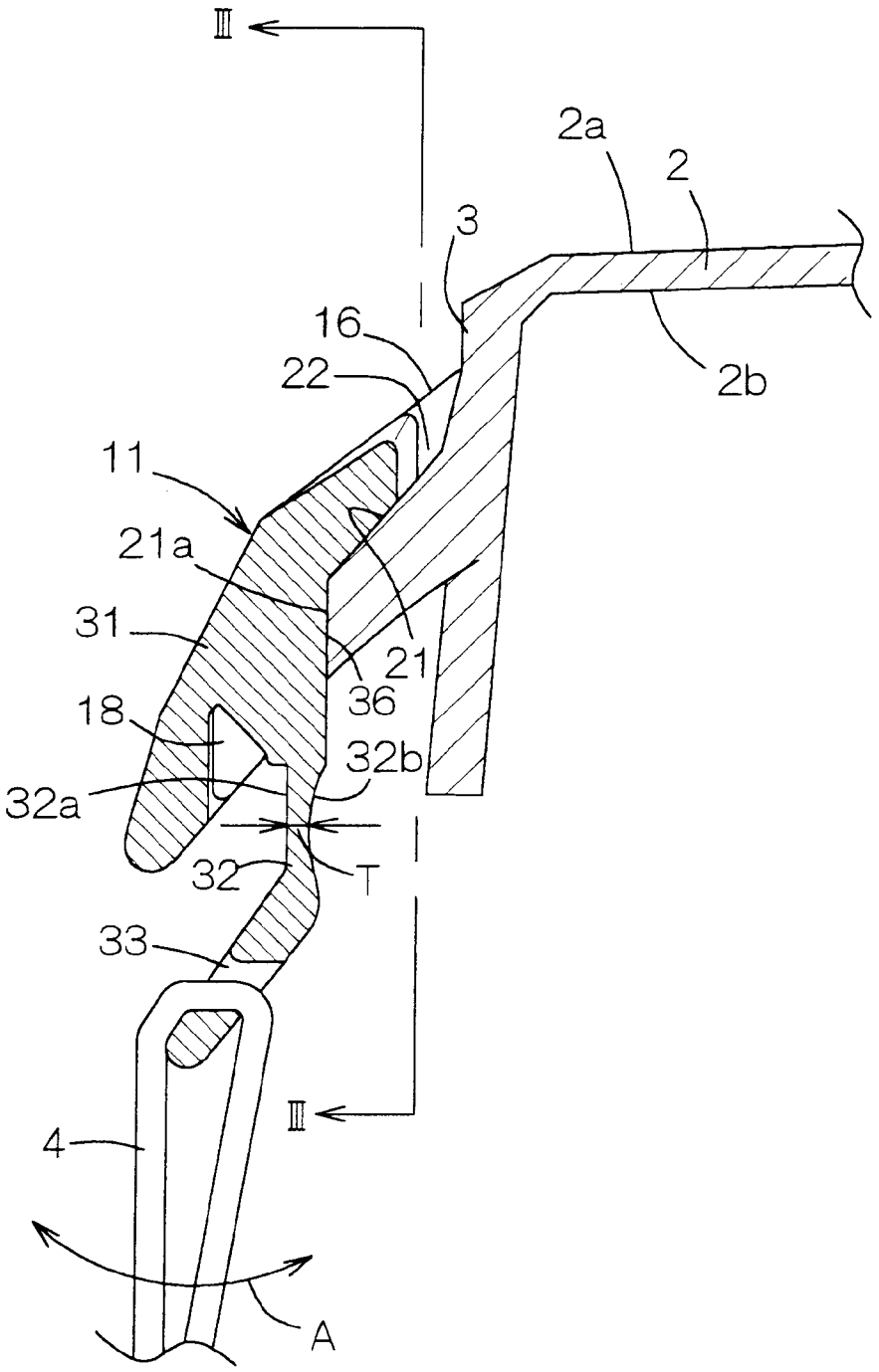
FIG. 2 is a cross-sectional view taken along a line II—II in FIG. 1.
Figure 3:
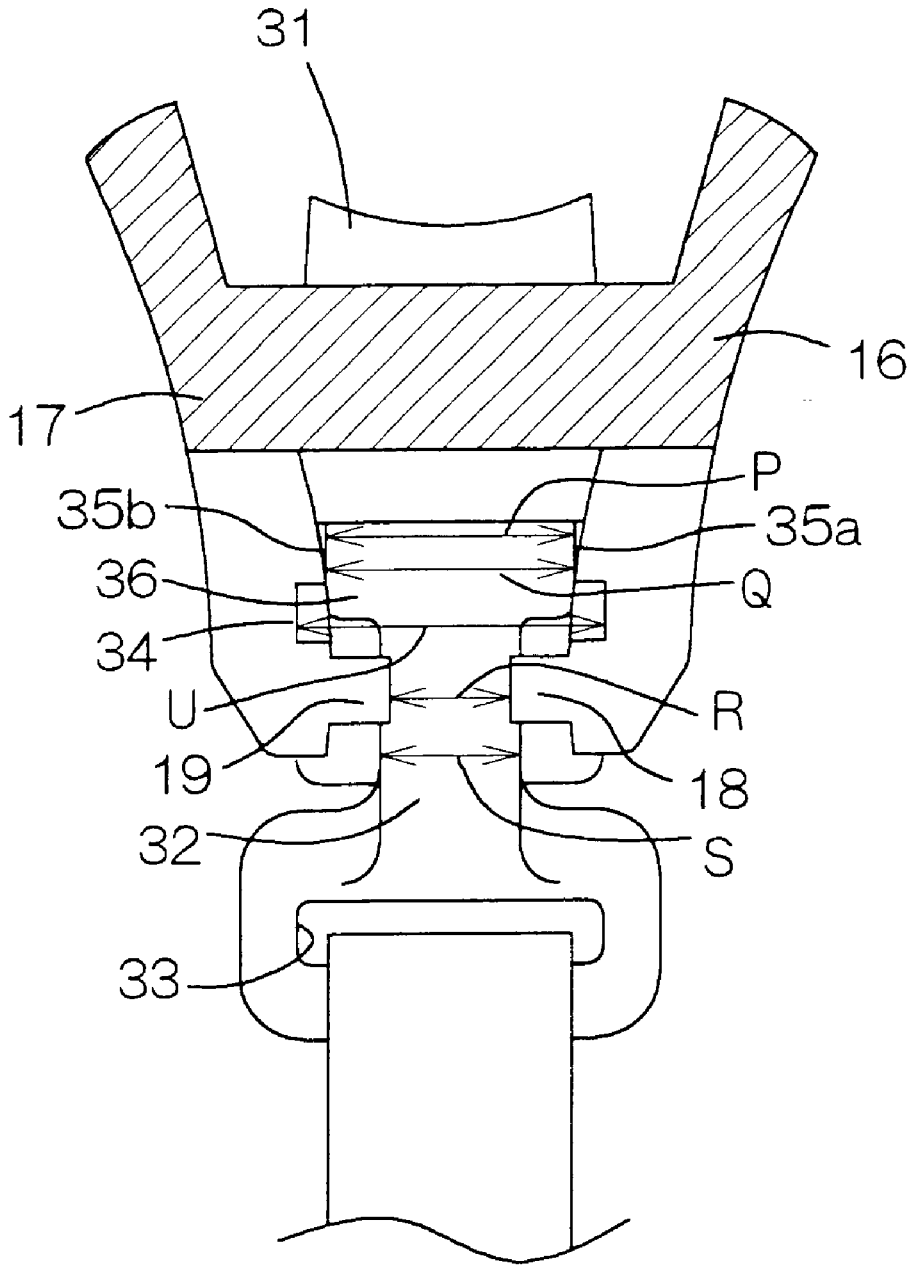
FIG. 3 is a cross-sectional view taken along a line III—III in FIG. 2.

FIG. 2 is a cross-sectional view taken along a line II—II in FIG. 1 and FIG. 3 is a cross-sectional view taken along a line III—III in FIG. 2. The locking section 31 of the coupling member 11 is received in the recess 22 of the frame 3 defined between the upper arm 16 and the lower arm 17. In this state, the locking section 31 has its rear surface 36 brought in close contact with at least a part of the smooth section 21, for example, a forward end portion 21*a* from the front (from above as viewed in FIG. 2) and also in close contact with the respective projections 18, 19 of the upper and lower arms 16, 17 from the front. The belt-like section 32 extends rearward (downward as viewed in FIG. 2) from the rear surface 36 of the locking section 31 and passes between the upper and lower arms 16, 17. Preferably, the belt-like section 32 extends rearward in the direction substantially orthogonal to the front surface 2*a* of the lens 2 which is substantially planar so that the head band 4 attached to the rear end of the belt-like section 32 may extend rearward at an angle of 90° ±15° with respect to the front surface 2*a* of the lens 2. The belt-like section 32 is preferably dimensioned so that its longitudinally middle region may have the smallest thickness T. More preferably, this smallest thickness T is defined by a planar outer surface 32*a* and a concave inner surface 32*b* of the belt-like section 32, as will be best seen in FIG. 2. The head band 4 is preferably movable together with the belt-like section 32 in a direction indicated by a double-headed arrow A. With the belt-like section 32 having its smallest thickness T in its longitudinally middle region, such a movement in the direction of the double-headed arrow A is facilitated. Particularly with the illustrated embodiment, the head band 4 can be easily moved toward the wearer's temporal so as to be in close contact therewith. On the side of the rear surface 36 of the coupling member 11, as will be best seen in FIG. 3, the locking section 31 has a width P and the belt-like section 32 has a width S. In the frame 3, on the other hand, the upper and lower arms 16, 17 are spaced from each other by a distance Q and the projections 18, 19 are spaced from each other by a distance R. The width P is larger than the width S, and the distance Q is larger than the distance R. The width P is substantially equal to or slightly smaller than the distance Q and larger than the distance R. The width S may be larger than the distance R as in FIG. 3 or may be smaller than the distance R. The head band 4 is inserted into the band insertion slot 33 provided in the rear end portion of the belt-like section 32. As the pair of goggles 1 are worn and the head band 4 is pulled downward as viewed in FIGS. 2 and 3, the locking section 31 of the coupling member 11 is reliably brought into close contact with the respective projections 18, 19 of the upper and lower arms 16, 17 as well as with the end potion 21*a* of the smooth section 21 from the front without any anxiety that the locking section 31 might fall off rearward from the space between the upper and lower arms 16, 17. The locking section 31 having been received in the recess 22 securely fills any gap between the upper and lower arms 16, 17 and thereby prevents a possibility that such gap might generate undesirably high resistance against water flow during swimming.

In the coupling member 11, the thickness T of the belt-like section 32 is preferably dimensioned to be sufficiently smaller than the distance R between the projections 18, 19 of the frame 3, as has already been described, so that the belt-like section 32 may smoothly move together with the head band 4 in the direction indicated by the double-headed arrow A and may smoothly pass between those projections 18, 19 as the coupling member 11 is received in the recess 22 of the frame 3. If the belt-like section 32 is guided between the projections 18, 19 with the inner and outer surfaces 32*a*, 32*b* respectively facing the upper and lower arms 16, 17, respectively when the coupling member is engaged with the recess 22, no significant force is required. Alternatively, the width S, instead of the thickness T, of the belt-like section 32 may be dimensioned to be smaller than the distance R or both the width S and the thickness T may be dimensioned to be smaller than the distance R for the same purpose. At least one of the width S and the thickness T may be dimensioned to be smaller than the distance R to alleviate a force required to guide the belt-like section 32 between the projections 18, 19. A width or distance U between the stopper projections 34, 34 in the locking section 31 is larger than the distance Q. The locking section 31 dimensioned in this manner may be elastically deformed as it is received in the recess 22 of the frame 3. The locking section 31 having been received in the recess 22 leaves substantially no gap between the upper and lower arms 16, 17 and, as seen in FIG. 3, the stopper projections 34 lie behind the upper and lower arms 16, 17 so as to prevent the locking section 31 from falling off forward from the recess 22.

To decouple the coupling member 11 having its locking section 31 received in the recess 22, the locking section 31 may be pushed forward with respect to the upper and lower arms 16, 17 while the stopper projections 34 are elastically deformed by pushing the rear surface 36 of the locking section 31 and thereafter the belt-like section 32 may be guided between the projections 18, 19 of the upper and lower arms 16, 17. The stopper projections 34 may be formed so as to project slightly highly from the side surfaces 35*a*, 35*b* and thereby a force required to elastically deform them can be alleviated. The force required to thrust the locking section 31 out can be further reduced when only one of the side surfaces 35*a*, 35*b* of the locking section 31 is provided with the stopper projection 34.

The goggles for swimming according to this invention is characterized in that the frames encircling the respective lenses are connected with the head band by means of the rubbery elastic coupling member so that this coupling member may be detachably coupled to the frames by guiding the belt-like section between the upper and lower arms extending rearward from the frames wherein the belt-like section has the width or the thickness smaller than the distance between the ends of those upper and lower arms. With this unique arrangement, no significant force is required to couple or decouple the head band to or from the frames for the purpose of, for example, length adjustment of the head band.

What is claimed is:

1. A pair of goggles for swimming comprising a pair of lenses each having front and rear surfaces, a pair of frames encircling said respective lenses and a head band coupled to respective rear ends of said frames; said pair of goggles for swimming is further comprising:

each of said frames has upper and lower arms extending rearward from the associated end of said rear ends in parallel to each other, said upper and lower arms having projections opposed to each other on respective rear ends wherein a distance between said projections is smaller than a distance between said upper and lower arms as measured in front of said projections; and said head band being coupled to said frames by means of rubbery elastic coupling members and adapted to be detachably held between said upper and lower arms, each of said coupling members comprising a locking section extending between said upper and lower arms and adapted to come in close contact with said projections from the front, and in contact with a part of said frame near said lenses rather than said projections from the front, a flexible belt-like section extending rearward from the rear end of said locking section and passing between said upper and lower arms, and a slot formed in the rear end of said belt-like section for insertion of the head band wherein at least one of width and thickness of said belt-like section is smaller than a distance between said projections.

2. A pair of the goggles according to claim 1, wherein said head band is provided behind said coupling members with buckles for length-adjustment of said head band.

3. A pair of the goggles according to claim 1, wherein, between said upper and lower arms, there is provided a region adapted to come in close contact with the rear surface of said locking section.

4. A pair of the goggles according to claim 1, wherein said locking section has a side surface opposed to said upper arm and a side surface opposed to said lower arm, at least one of these side surfaces is formed, in the vicinity of said rear surface, with a stopper projection adapted to come in close contact with said upper arm or said lower arm in the direction from the rear surface toward the front surface of said locking section and thereby to prevent said locking section from falling off forward from between said upper and lower arms.

5. A pair of the goggles according to claim 1, wherein said belt-like section of said coupling member has its thickness dimensioned to be smaller in a longitudinally middle region thereof.

6. A pair of the goggles according to claim 1, wherein said head band is coupled to the rear end of said belt-like section so as to extend rearward therefrom at an angle of 90°±15° with respect to the front surface of said lens.

* * * * *